US012757966B2

(12) United States Patent
Snyder

(10) Patent No.: US 12,757,966 B2
(45) Date of Patent: Oct. 13, 2026

(54) REMOVABLE CAP PROTECTOR

(71) Applicant: Snyder Innovations LLC, Lacey, WA (US)

(72) Inventor: Robert A. Snyder, Lacey, WA (US)

(73) Assignee: Snyder Innovations LLC, Lacey, WA (US)

( * ) Notice: Subject to any disclaimer, the term of this patent is extended or adjusted under 35 U.S.C. 154(b) by 0 days.

(21) Appl. No.: 19/163,338

(22) PCT Filed: Mar. 6, 2024

(86) PCT No.: PCT/US2024/018699
§ 371 (c)(1),
(2) Date: Sep. 8, 2025

(87) PCT Pub. No.: WO2024/186910
PCT Pub. Date: Sep. 12, 2024

(65) Prior Publication Data

US 2026/0114539 A1 Apr. 30, 2026

Related U.S. Application Data

(60) Provisional application No. 63/488,543, filed on Mar. 6, 2023.

(51) Int. Cl.
*A42C 5/02* (2006.01)

(52) U.S. Cl.
CPC ..... *A42C 5/02* (2013.01)

(58) Field of Classification Search
CPC ..... A42C 5/02; A42C 1/002; A42C 3/127; A42C 1/008; A42C 5/00
See application file for complete search history.

(56) References Cited

U.S. PATENT DOCUMENTS

| | | | | |
|---|---|---|---|---|
| 5,481,760 | A * | 1/1996 | Wood, Jr. | A42B 1/0181 2/181.6 |
| 5,566,395 | A | 10/1996 | Nebeker | |
| 5,887,284 | A | 3/1999 | Simmons | |
| 5,920,910 | A * | 7/1999 | Calvo | A42C 5/02 2/DIG. 11 |
| 6,467,095 | B1 * | 10/2002 | Nunnery | A42C 5/02 2/181.6 |
| D909,019 | S | 2/2021 | Johnson | |
| 11,191,317 | B2 | 12/2021 | Soibelman | |
| 11,857,021 | B1 * | 1/2024 | Wright | A42B 1/002 |

(Continued)

*Primary Examiner* — Haley A Smith

(57) ABSTRACT

The removable cap protector is a protector that can be removed, washed, and reused once absorbing excess moisture. An objective of the removable cap protector is to provide users with a device that retains the original shape and integrity of the cap the present invention is secured into. The removable cap protector is intended to provide users with a device that can prevent or reduce sweat stains. The removable cap protector has a non-woven layer and a foam layer, each of which are thin pads. The non-woven layer and the foam layer are secured to each other along their respective flat sides. The non-woven layer has a bonding mechanism, a water-resistant backing, a plurality of non-woven layer ridges, a non-woven layer bottom section, and a non-woven layer top section. The foam layer has a plurality of foam layer ridges, a foam layer bottom section, and a foam layer top section.

10 Claims, 7 Drawing Sheets

(56) References Cited

U.S. PATENT DOCUMENTS

| | | | | |
|---|---|---|---|---|
| 2013/0205470 | A1* | 8/2013 | Johnson | A42B 3/10 2/181.4 |
| 2015/0335085 | A1* | 11/2015 | Williams | A42B 1/002 2/195.5 |
| 2016/0255897 | A1 | 9/2016 | Johnson et al. | |
| 2020/0154808 | A1* | 5/2020 | Inouye | A42B 1/008 |
| 2022/0087354 | A1* | 3/2022 | Woods-Malmuth | A42C 5/02 |
| 2026/0114539 | A1* | 4/2026 | Snyder | A42B 1/002 |

* cited by examiner

REMOVABLE CAP PROTECTOR

FIELD OF THE INVENTION

The present invention relates generally to a removable cap protector for caps and hats with an interior band. More specifically, the present invention is a device that can fully protect the interior band and absorb moisture without getting stuck within the attached cap or hat.

BACKGROUND OF THE INVENTION

Cap protectors are commonly used in caps or hats to prevent sweat from accumulating inside caps or hats and creating sweat stains or uncomfortable skin contact. Cap protectors are commonly made from absorbent materials such as cotton and foam to absorb sweat. Cap protectors are commonly used by individuals who wear caps or hats for an extended period such as athletes, outdoor enthusiasts, construction workers and the like. The cap protectors further prevent skin irritation and discomfort by ensuring the cap or hat stays relatively dry. Unfortunately, many cap protectors are not reusable and will stay attached to the cap or hat once the cap protector gets wet from absorbing sweat. This design creates an inconvenient and unsanitary situation where the cap or hat is limited to the cap protector that is stuck within on the interior band even after the protector becomes soiled and dirty. In addition, removal of a cap protector that has been fixed in place with adhesive often leaves sticky, unattractive and uncomfortable residue in the hat that cannot be completely removed without harming the hat's appearance and structure.

Existing cap protectors that do not include adhesive are tucked into interior band, leaving the interior band itself exposed to moisture, soiling and stains. The composition of the present device, however, allows a foam layer to tuck into the interior band of the cap while the other, moisture-absorbing layer is held suspended between the cap's interior band and the wearer's forehead, thus protecting the interior band rather than leaving the interior band directly exposed to the user's skin. Further, the tabular, ridged protrusions on the present device extend into the cap's dome to prevent distortion to the shape of the cap and enhance the user's comfort by preventing the protector material from wrinkling, pleating, and bunching. The tabular extensions into the dome of the hat thus ensure smooth, comfortable contact against the wearer's head.

An objective of the present invention is to provide users with a removable, washable, semi-reusable cap protector, to help eliminate sweat stains from the caps or hats. The present invention intends to provide users with a device that will not distort the shape of the cap, cause the wearer discomfort, or require any application of glue or other adhesive to stay secure while simultaneously providing moisture protection that extends of the interior band of the cap nearly to its edge. In order to accomplish this, a preferred embodiment of the present invention comprises a non-woven layer and a foam layer. Further, the foam layer is designed to shape the attached cap properly. Thus, the present invention is a removable, washable and semi-reusable cap protector that maintains the proper shape of a cap while providing an absorbent layer to reduce sweat stains without needing glue or adhesive to affix the present invention to an external cap and without exposing the interior band of the hat to moisture, soiling or staining.

DETAIL DESCRIPTIONS OF THE INVENTION

All illustrations of the drawings are for the purpose of describing selected versions of the present invention and are not intended to limit the scope of the present invention.

The present invention is a removable cap protector for caps or hats with interior bands. The present invention seeks to provide users with a device that can absorb excess moisture to prevent sweat stains. In order to accomplish this the present invention comprises a non-woven layer 1 that is designed to absorb and hold moisture positioned along the forehead side of a sweatband of an external cap. Further, the foam layer 2 is designed to retain the original shape of the cap and tuck into the sweatband of an external cap without requiring any adhesive on the external cap. The present invention is reusable up to four times when the non-woven 1 layer is washed with water and soap, and then hung to air dry. Thus, the present invention is a removable cap protector with two layers positioned to straddle the sweatband of an external cap, maintain the proper shape of the external cap and provide an absorbent layer to reduce sweat stains without exposing the interior band of the hat to moisture, soiling or staining.

As shown in FIG. 1-7, the present invention is a cap protector that can be removed from a cap once it has absorbed excess moisture and become soiled. An objective of the present invention is to provide users with a device that retains the original shape of the cap the present invention is secured into. The present invention intends to provide users with a device that can prevent or reduce sweat stains. To accomplish this the present invention comprises a non-woven layer 1 and a foam layer 2. The components allow for the present invention to be secured within a cap, maintain the cap shape, and protect the interior band of the hat without adhesive. The non-woven layer 1 and the foam layer 2 are partially secured to each other along their respective flat sides. Thus, the present invention is a removable cap protector that maintains the proper shape of a cap while providing an absorbent layer to reduce sweat stains.

Figure 1:
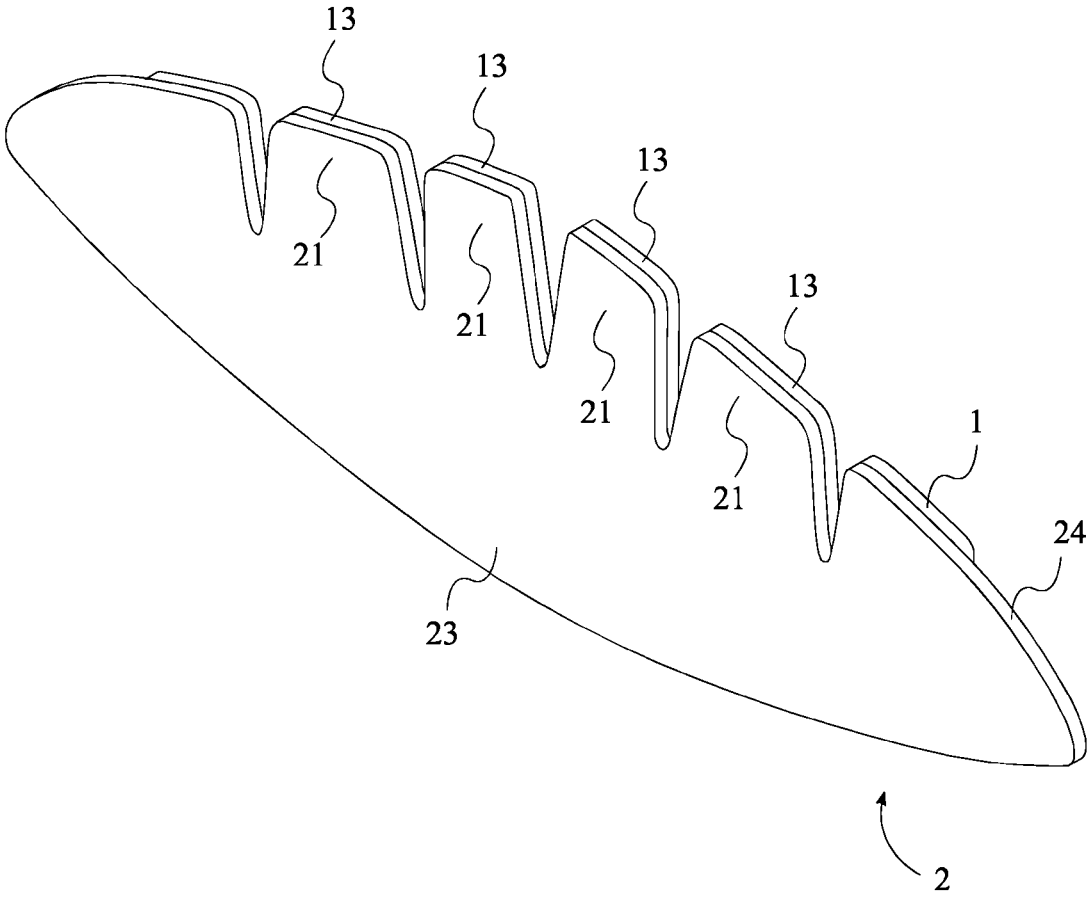
FIG. 1 is a front perspective view of the present invention.
Figure 6:
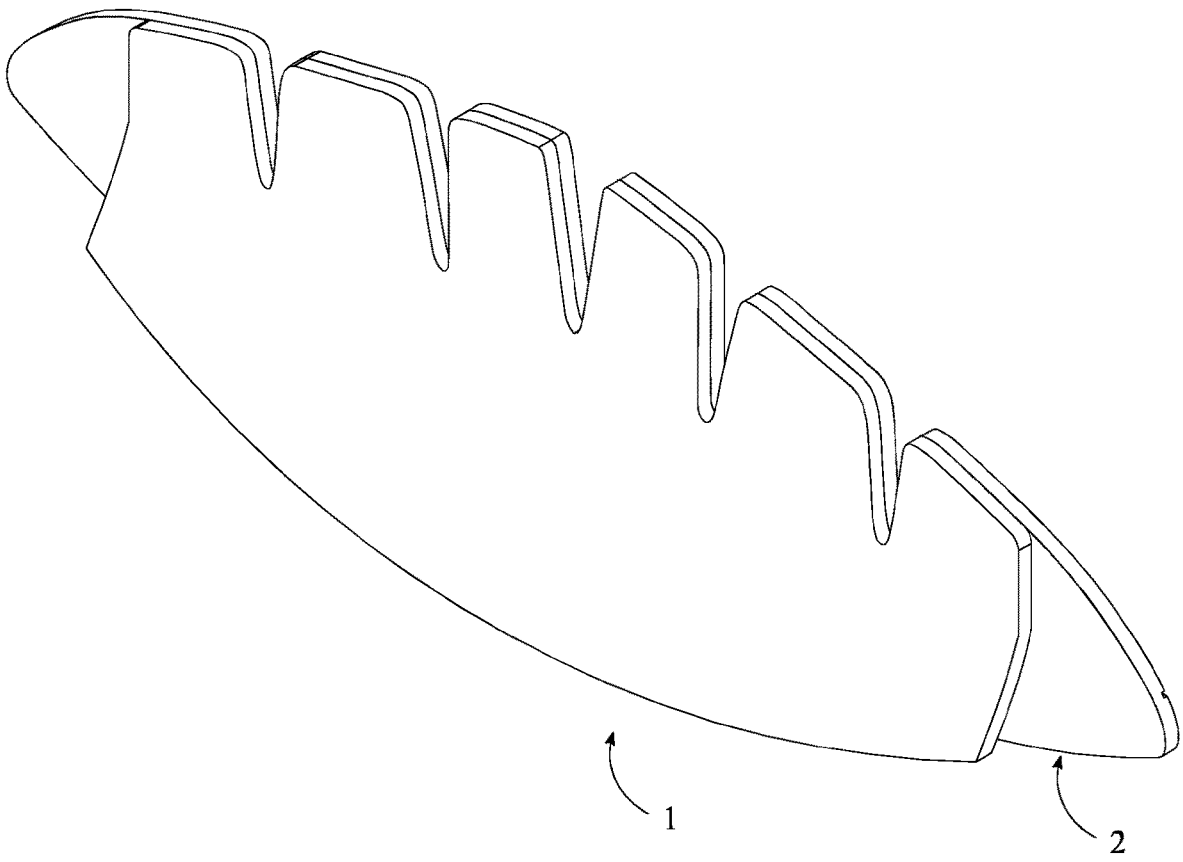
FIG. 6 is a perspective view of the present invention showing the non-woven layer hinged to allow for placement within a cap band.

In reference to FIG. 1, the removable cap protector comprises a non-woven layer 1 and a foam layer 2. The non-woven layer 1 comprises a non-woven layer bottom section 14, and a non-woven layer top section 15. The foam layer 2 comprises a foam layer bottom section 23, and a foam layer top section 24. A back side 151 of the non-woven layer top section 15 is attached to a front side 241 of the foam layer top section 24 via a bonding mechanism 11. A front side 152 of the non-woven layer top section 15 is provided with a water-resistant backing 12. The non-woven layer top section 15 comprises a plurality of non-woven layer ridges 13. The foam layer top section 24 comprises a plurality of foam layer ridges 21 that correspond to the plurality of non-woven layer ridges 13. The non-woven layer 1 is a thin pad. As a result, the non-woven layer 1 is a thin pad with a long oblong shape as seen in FIG. 6.

Figure 2:
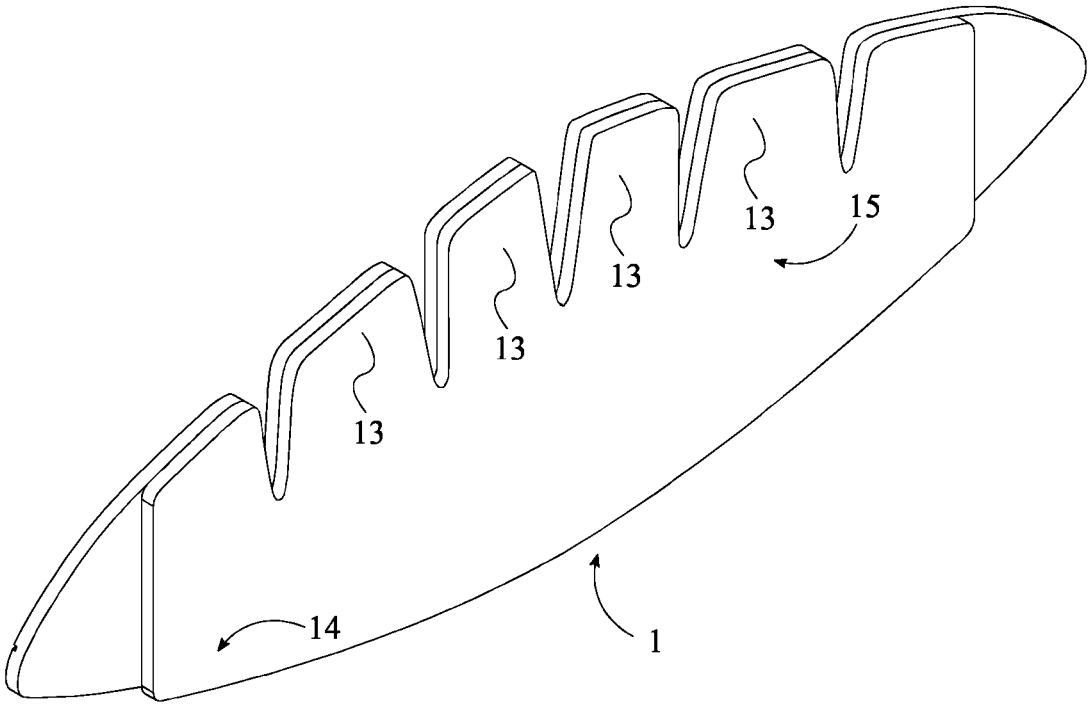
FIG. 2 is a rear perspective view of the present invention.
Figure 3:
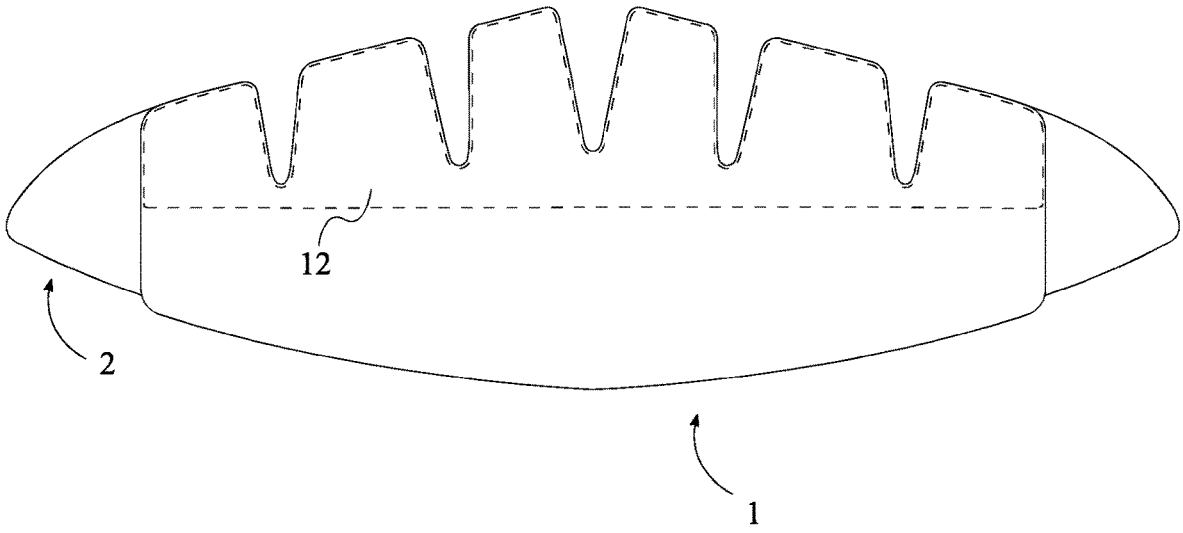
FIG. 3 is a front view of the present invention with a dotted line depicting the water-resistant backing not seen, underneath the non-woven layer.
Figure 4:
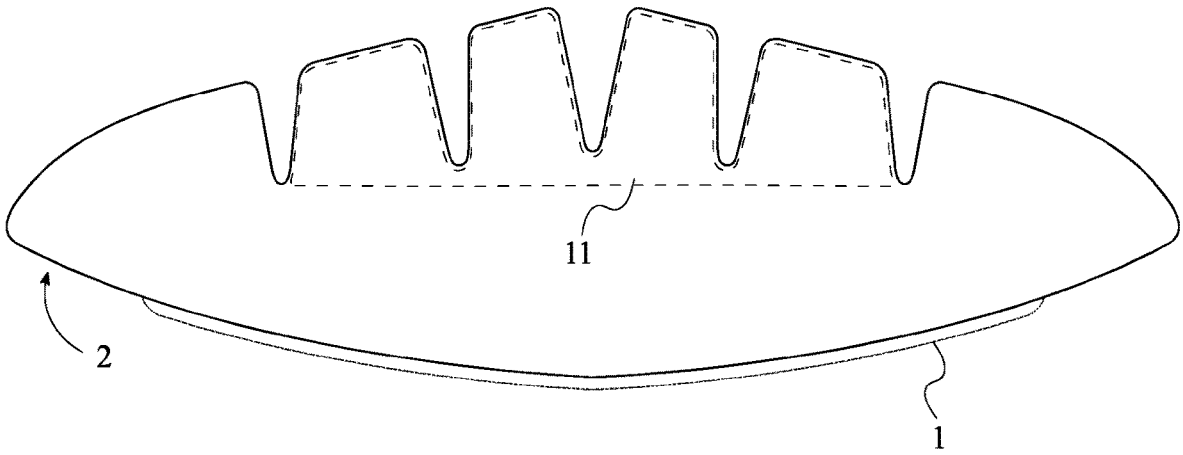
FIG. 4 is a rear view of the present invention with a dotted line depicting the bonding mechanism not seen, underneath the foam layer.
Figure 5:
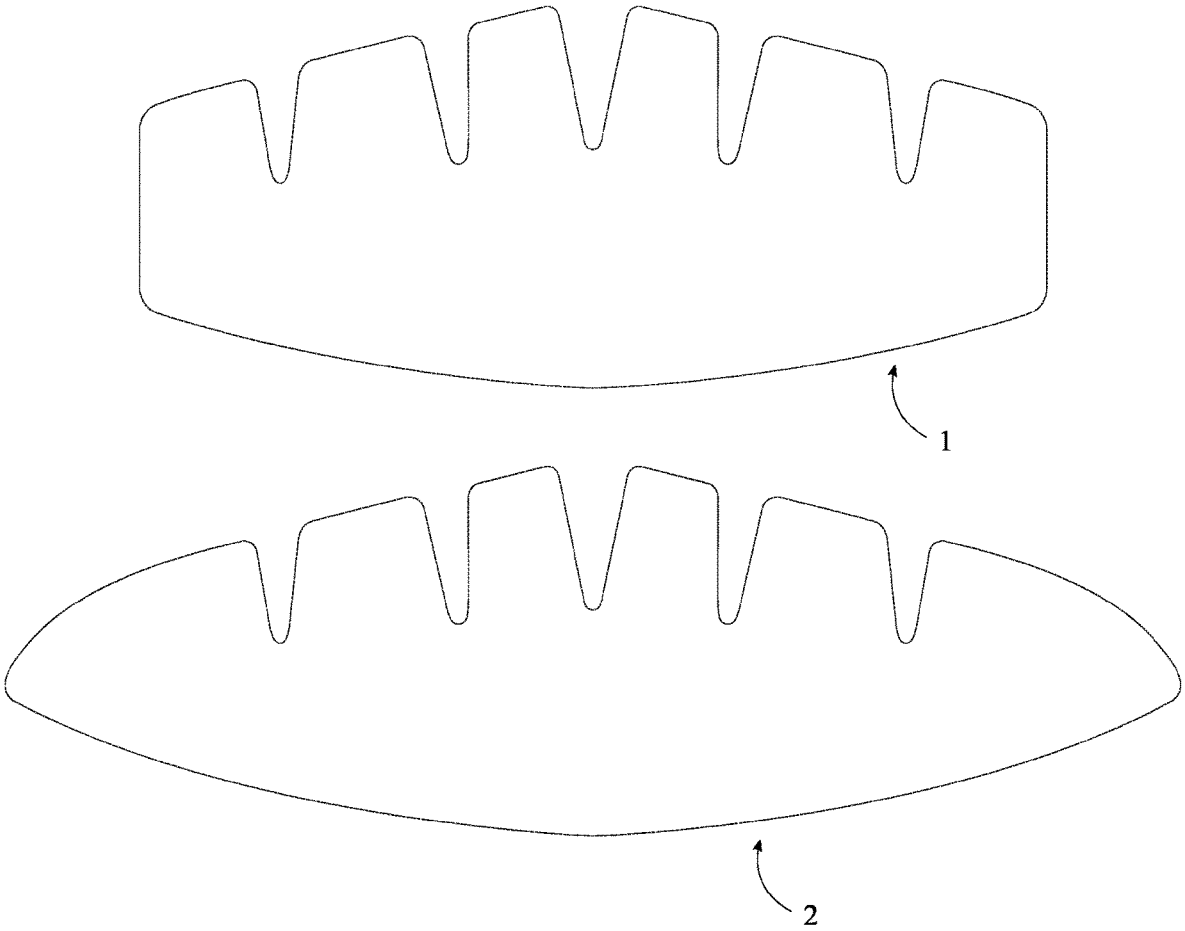
FIG. 5 is a front view of the individual die cut shapes of the non-woven layer and foam layer separated.

Further, the non-woven layer 1 shown in FIG. 2 absorbs excess liquid. Thus, the non-woven layer 1 is designed to properly absorb excess moisture to prevent sweat stains. The non-woven layer 1 is a soft material. So, the soft material is cotton or another similar material. Furthermore, the non-woven layer 1 prevents sweat stains on an external cap and covers the cap's interior sweatband while the foam layer bottom section 23 is tucked into the sweatband. As shown in FIG. 3, the non-woven layer 1 is an absorbent layer that comprises a secondary non-woven layer that is backed with a water-resistant backing 12 or a waterproof layer positioned along the rear side of the non-woven layer 1 which is the side of the invention positioned towards a forehead. These components are held together with an ultrasonic weld which is independent from the foam layer 2.

Furthermore, the plurality of non-woven layer ridges 13 traverses along the top side of the non-woven layer 1 as seen in FIG. 2. As a result, the plurality of non-woven layer ridges 13 creates tabular protrusions extending upwards that allows the non-woven layer 1 to bend and flex without causing wrinkling, pleating or bunching of the material that could cause discomfort to the wearer and deform the hat's curved dome. The plurality of non-woven layer ridges 13 is evenly spaced along the non-woven layer 1. Consequently, the plurality of non-woven layer ridges 13 bends with a consistent curve that matches the curve of a human forehead or cap.

In reference to FIG. 3, the water-resistant backing 12 covers the front of the non-woven layer 1. Accordingly, the water-resistant backing 12 covers the entire front side of the non-woven layer 1 and is designed with a waterproof material. The water-resistant backing 12 prevents liquid from passing through the non-woven layer 1 to the foam layer 2. Thus, the water-resistant backing 12 prevents moisture from passing through the non-woven layer 1.

Further, the non-woven layer top section 15 is positioned along the top half of the non-woven layer 1 as seen in FIG. 1. The non-woven layer bottom section 14 is positioned along the bottom half of the non-woven layer 1 below the non-woven layer top section 15. The bonding mechanism 11 covers the front of the water-resistant backing 12 that intersects with the area of the non-woven layer top section 15. So, the bonding mechanism 11 is in contact with the foam layer 2 and is positioned on the flat side of the non-woven layer 1 over top of the water-resistant backing 12. The bonding mechanism 11 secures the non-woven layer top section 15 to the foam layer top section 24. As a result, the bonding mechanism 11 creates a permanent bond that secures the non-woven layer 1 to the foam layer 2. In its preferred embodiment, the bonding mechanism may comprise an area that is small enough to keep the non-woven layer 1 attached to the foam layer 2 while simultaneously allowing the device user to use ordinary scissors to trim the bottom or top of the foam layer 2 to custom fit the device to the particular dimensions of the user's cap, without compromising the integrity or coverage of the non-woven layer 1.

In reference to FIG. 3, the foam layer 2 is shorter and wider than the non-woven layer 1. Consequently, the foam layer 2 curves outwards towards a point. The non-woven layer 1 is designed with a slightly taller height than the foam layer 2, which creates a slight overhang of material at the bottom. This allows the non-woven layer 1 to ensure coverage over the center of the foam layer 2 to ensure that the present invention properly absorbs moisture. To ensure adjustability the foam layer 2 can be cut to a smaller size as needed anywhere the foam layer 2 is not secured to the non-woven layer 1. The foam layer 2 is a flexible material. Accordingly, the foam layer 2 is designed with a firm yet flexible material that can bend but tries to retain the original flat shape shown in FIG. 2. The foam layer 2 is a water resistant-plastic and foam material. Thus, the foam layer 2 is preferably ethylene-vinyl acetate (EVA) or another material that is a cross between a water-resistant plastic and foam. The foam layer 2 is lightweight. So, the lightweight of the foam layer 2 ensures an external cap feels unaltered when worn with the present invention.

In reference to FIG. 1, the plurality of foam layer ridges 21 traverses along the top side of the foam layer 2. As a result, the plurality of foam layer ridges 21 is designed with the same size and shape as the plurality of non-woven layer ridges 13. The plurality of foam layer ridges 21 is evenly spaced along the foam layer 2. The plurality of foam layer ridges 21 matches the positioning of the plurality of non-woven layer ridges 13. Consequently, the plurality of foam layer ridges 21 is positioned in line with the plurality of non-woven layer ridges 13 and allows the present invention to bend and flex without creating unwanted wrinkles, pleats or bunches of material.

In reference to FIG. 1, the foam layer top section 24 is positioned along the top half of the foam layer 2. The foam layer bottom section 23 is positioned along the bottom half of the foam layer 2 below the foam layer top section 24. The external cap contacts the front side 241 of the foam layer top section 244. Accordingly, a sweatband of the external cap is positioned behind the foam layer bottom section 23 in contact with the external cap.

Figure 7:
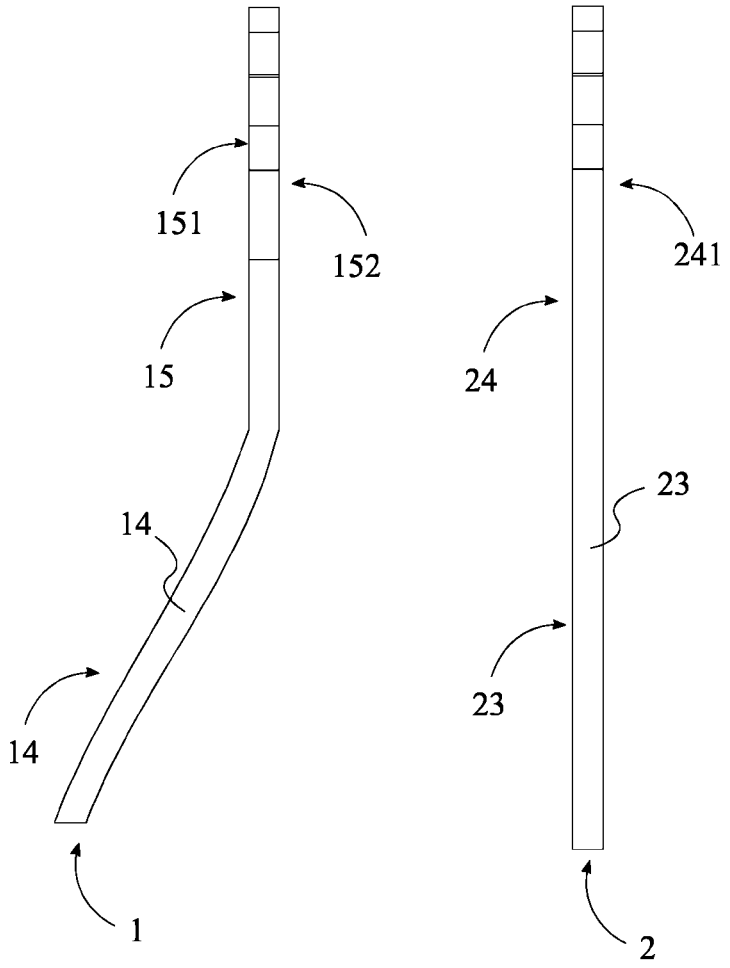
FIG. 7 is an exploded side view of the present invention showing the non-woven layer hinged to allow for placement within a cap band.

Further, the sweatband of the external cap secures the foam layer bottom section 23 to an external cap. Thus, the sweatband of the external cap further ensures that the present invention stays secured to the cap and does not move around. The foam layer bottom section 23 fits into an external cap. So, the non-woven layer 1 splits aways from the foam layer 2 halfway down the non-woven layer 1 at the non-woven layer bottom section 14 and the foam layer bottom section 23. This design allows the foam layer bottom section 23 to be tucked under the band of a cap securing the present invention in place while the non-woven layer 1 is positioned on the other side of the cap in contact with the user's forehead. The non-woven bottom section folds away from the foam layer bottom section 23 as shown in FIG. 7. As a result, this design allows for the bottom half of the non-woven layer 1 to fold outwards from the foam layer 2 as needed. In this way, the device straddles the sweatband of the cap with the non-woven layer bottom section 14 against the wearer's skin which serves to protect the cap's sweatband from moisture, soiling and stains without requiring adhesive to be applied to the cap.

Although the invention has been explained in relation to its preferred embodiment, it is to be understood that many other modifications and variations can be made without departing from the spirit and scope of the invention as hereinafter claimed.

What is claimed is:

1. A removable cap protector comprising:

a non-woven layer;

a foam layer;

the non-woven layer comprising a non-woven layer bottom section and a non-woven layer top section;

the foam layer comprising a foam layer bottom section and a foam layer top section;

a back side of the non-woven layer top section being attached to a front side of the foam layer top section via a bonding mechanism;

a front side of the non-woven layer top section being provided with a water-resistant backing;

the non-woven layer top section comprising a plurality of non-woven layer ridges;

the foam layer top section comprising a plurality of foam layer ridges that correspond to the plurality of non-woven layer ridges.

2. The removable cap protector as claimed in claim 1 comprising:

the non-woven layer absorbing excess liquid; and the non-woven layer being a soft material.

3. The removable cap protector as claimed in claim 2 wherein the non-woven layer prevents sweat stains on an external cap.

4. The removable cap protector as claimed in claim 1 comprising:

the plurality of non-woven layer ridges traversing along the top side of the non-woven layer; and the plurality of non-woven layer ridges being evenly spaced along the non-woven layer.

5. The removable cap protector as claimed in claim 1 comprising:

the water-resistant backing covering the front of the non-woven layer; and the water-resistant backing preventing liquid from passing through the non-woven layer to the foam layer.

6. The removable cap protector as claimed in claim 5 comprising:

the non-woven layer top section being positioned along the top half of the non-woven layer;

the non-woven layer bottom section being positioned along the bottom half of the non-woven layer below the non-woven layer top section;

the bonding mechanism covering the front of the water-resistant backing intersecting with the area of the non-woven layer top section; and the bonding mechanism securing the non-woven layer top section to the foam layer top section.

7. The removable cap protector as claimed in claim 1 comprising:

the foam layer being shorter and wider than the non-woven layer;

the foam layer being a flexible material;

the foam layer being a water-resistant plastic and foam material; and the foam layer being lightweight.

8. The removable cap protector as claimed in claim 1 comprising:

the plurality of foam layer ridges traversing along the top side of the foam layer;

the plurality of foam layer ridges being evenly spaced along the foam layer; and the plurality of foam layer ridges matching the positioning of the plurality of non-woven layer ridges.

9. The removable cap protector as claimed in claim 1 comprising:

the foam layer top section being positioned along the top half of the foam layer; and the foam layer bottom section being positioned along the bottom half of the foam layer below the foam layer top section.

10. The removable cap protector as claimed in claim 9 comprising:

the foam layer bottom section fitting into an external cap; and the non-woven bottom section folding away from the foam layer bottom section.

* * * * *